United States Patent [19]

Pensa

[11] 4,013,380

[45] Mar. 22, 1977

[54] CONTROL SYSTEMS FOR VARIABLE CAPACITY HYDRAULIC MACHINES

[75] Inventor: Carlo Pensa, Como, Italy

[73] Assignee: Massey-Ferguson Services N.V., Curacao, Netherlands Antilles

[22] Filed: Nov. 17, 1975

[21] Appl. No.: 632,734

[30] Foreign Application Priority Data

Nov. 18, 1974 United Kingdom ..... 49873/74

[52] U.S. Cl. ..... 417/218; 60/444

[51] Int. Cl.[2] ..... F04B 1/26

[58] Field of Search ..... 60/444, 447; 417/218–222; 91/506

[56] References Cited

UNITED STATES PATENTS

| | | | |
|---|---|---|---|
| 2,932,948 | 4/1960 | Neff et al. | 60/444 |
| 3,057,162 | 10/1962 | Lee | 60/444 |
| 3,217,493 | 11/1965 | Kempson et al. | 60/444 |
| 3,266,434 | 8/1966 | McAlvay | 417/222 |
| 3,660,975 | 5/1972 | Martin et al. | 60/447 |
| 3,672,166 | 6/1972 | Isaac | 60/447 |
| 3,736,073 | 5/1973 | Walmsley | 417/222 |
| 3,861,832 | 1/1975 | Pinson | 60/444 |

*Primary Examiner*—Carlton R. Croyle
*Assistant Examiner*—G. P. LaPointe
*Attorney, Agent, or Firm*—Thomas P. Lewandowski

[57] ABSTRACT

A hydraulic machine is provided with a control for reducing the capacity of the machine when subjected to excessive pressure.

A piston is slidable in a cylinder to define two chambers, the chambers being interconnected by a restrictive passage. One chamber is connected to the pressure line and the other chamber is connected to a relief valve so that in the steady state the pressure in each is equal. When the pressure reaches a predetermined level the relief valve opens and vents the other chamber. The passage prevents flow to the other chamber creating a pressure differential which causes the piston to move along the cylinder and operate the machine control to decrease the capacity thereof.

7 Claims, 1 Drawing Figure

CONTROL SYSTEMS FOR VARIABLE CAPACITY HYDRAULIC MACHINES

Figure 1:
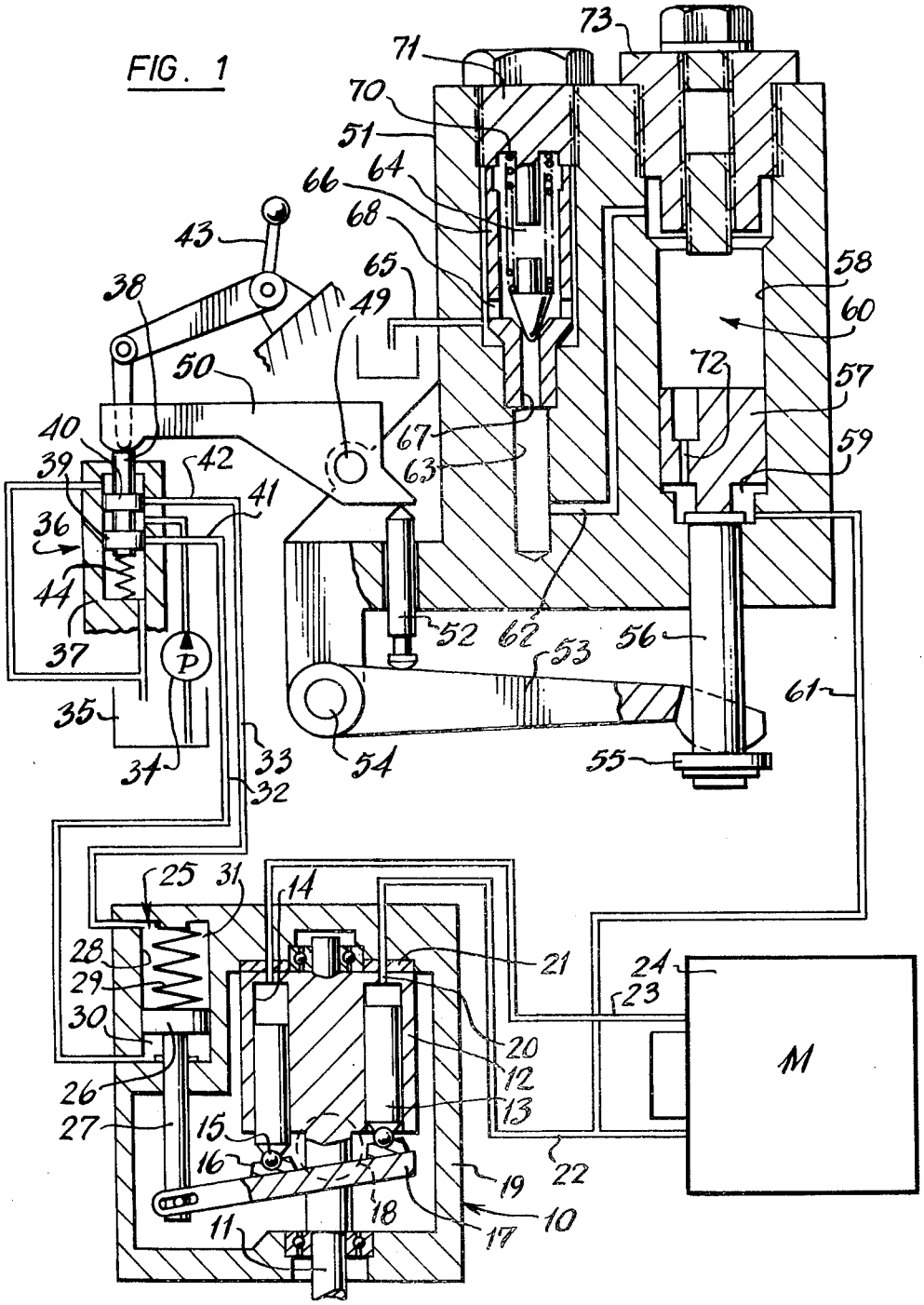

This invention relates to variable capacity hydraulic machines and in particular to controls therefore.

It is well known to use a variable capacity hydraulic machine as a pump to deliver fluid to a motor or the like. The pressure of the fluid delivered by the pump will vary according to the load placed on the motor. It is therefore usual to provide a relief pump to protect the pump from excessive pressures. However, upon the relief valve blowing the pump continues to deliver hydraulic fluid which passes through the relief valve and so causes heating of the fluid.

Variable capacity pumps are therefore provided with a compensating device which is sensitive to the pressure of fluid delivered by the pump and operates to reduce the capacity of the pump upon the pressure reaching a predetermined level.

It is an object of the present invention to provide a control device of the above type which operates at a predetermined pressure irrespective of the capacity of the pump and which is robust and simple to manufacture.

According to the present invention there is provided a control for a variable capacity hydraulic machine having adjusting means for varying the capacity thereof, including a servo motor and valve means to control said servo motor, manual control means operable upon said valve means to cause flow to or from said servo motor, said control comprising override means operable upon said servo motor to cause movement thereof to reduce the capacity of said machine, actuating means operable upon said override means and including a piston slidable within a cylinder and defining two chambers therein connected by a restrictive passage, one of said chambers being subjected to the pressure of fluid delivered to or by said machine and the other of said chambers being connected to a pressure regulator, the arrangement being that upon attainment of a predetermined pressure in said other chamber said pressure regulator vents said other chamber and causes said piston to move relative to said cylinder to actuate said override means.

An embodiment of the invention will now be described by way of example only with reference to the accompanying drawings in which FIG. 1 is a diagrammatic representation partly in section of a control for a hydraulic pump.

Referring now to FIG. 1, a variable capacity pump 10 is driven by a shaft 11 which rotates a barrel 12. Pistons 13 are slidably mounted in cylinders 14 formed in the barrel 12 and are connected by spherical joints 15 to a slipper ring 16. The ring 16 co-operates with a swashplate 17 which is pivotally mounted by bearings 18 to a casing 19.

Each cylinder 14 communicates by a passage 20 with a valve plate 21 which controls flow between the cylinders 14 and supply and discharge conduits 22, 23 respectively. The conduits 22, 23 are connected to a hydraulic motor 24 which may be of any convenient type.

The inclination of the swashplate 17 is controlled by a servomotor 25 comprising a piston 26, a piston rod 27 connected between the piston 26 and the swashplate 17, a cylinder 28 formed in the casing 19 and a spring 29 biasing the piston 26 toward the swashplate 17. The piston 26 divides the cylinder 28 into two chambers 30, 31 which are respectively connected to control lines 32, 33. A spool valve 36 controls fluid delivered by a pump 34 from a sump 35 to the control lines 32, 33 and comprises a body 37, and a spool 38 which has lands 39, 40. The control lines 32, 33 are connected to ports 41, 42 which are controlled by the lands 39, 40 respectively. The spool 38 is acted upon by a control lever 43 and movement of the spool is opposed by a spring 44.

The spool 38 is also acted upon by a link 50 which is pivoted to a housing 51 by a pin 49. A rod 52 is slidably mounted within the housing 51 and bears against one end of the link 50. The other end of the rod 52 abuts a lever 53 which is pivoted at one end to the housing 51 by a pin 54. The other end of the lever 53 is forked and co-operates with a shoulder 55 formed on a piston rod 56. The piston rod 56 is connected to a piston 57 slidably mounted in a bore 58 formed in the housing 51. The piston 57 divides the bore 58 into two chambers 59, 60, one of which, 59 is connected by a signal line 61 to the supply conduit 22. The chamber 60 is connected by a duct 62 to a bore 63 which houses a relief valve assembly 64 for controlling flow between the bore 63 and the sump 35 by way of a drain line 65. The relief valve 64 comprises a body 66 having a supply port 67 and a discharge port 68. A poppet 69 controls flow through the port 67 and is biased toward it by a spring 70. The body 66 is retained within the bore 63 by an end cap 71 which also serves as a reaction member for the spring 70.

The chambers 59, 60 are hydraulically connected by an orifice 72 in the piston 57 and movement of the piston 57 is limited by a stop 73 screwed into the housing 51.

The operation of the apparatus is as follows. The shaft 11 rotates the barrel 12 and causes the slipper ring 16 to rotate on the swashplate 17. This causes the pistons 13 to reciprocate and expel fluid from the bores 14 and into the discharge conduit 22 as they approach the valve plate 21 and suck fluid from the supply conduit 23 as they move away from the valve plate 21. The motor 24 is thus caused to rotate due to the flow of fluid from the conduit 22 into the conduit 23.

The capacity of the pump 10 is regulated by the inclination of the swashplate 17, the greater the inclination the greater the stroke of the pistons 12 and thus the flow rate of fluid from the pump 10.

The inclination of the swashplate 17 is adjusted by movement of the control member 43. Clockwise movement will allow the spool 38 to move along the body 37 and the land 40 will uncover the control line 33 to allow flow from the pump 34 into the chamber 31. The piston 26 will move so as to expel fluid from the chamber 30 into the control line 32 through the port 41 to the sump 35 by way of the drain line. The swashplate will thus pivot on the bearings 18 and increase the stroke of the pistons 13. Movement of the swashplate is stopped by returning the spool 38 to a position in which the ports 41, 42 are blocked by the lands 39, 40.

If the control member 43 is rotated in an anticlockwise direction the spool 38 is moved to compress the spring 44 and allow flow from the pump 34 into the control line 32. The piston 26 is thus moved to increase the volume of the chamber 30 and expel fluid from the chamber 31 through the control line 33 to the sump 35. Thus the capacity of the pump 10 is decreased.

Should a high load be placed on the motor 24 the pressure in the conduit 22 may become excessive and so it is necessary to provide a system to limit the maximum pressure in the conduit 22.

The pressure in the conduit 22 is transmitted to the chambers 59, 60 by way of the signal line 61 and the orifice 72 and from the chamber 60 to the bore 63 by the duct 62. Thus the pressure in the conduit 22 is acting at the port 67 on the poppet 69. Should the pressure rise above a predetermined value the pressure of the fluid will overcome the force of the spring 70 and move the poppet 69 to allow fluid to flow out of the bore 63 and chamber 60. The orifice 72 restricts flow into the chamber 60 and so a pressure differential exists across the piston 57 causing it to move along the bore 58 towards the stop 73. This causes the lever 53 to pivot anticlockwise about the pin 54 and push the rod 52 against the link 50.

The link 50 rotates anticlockwise about the pin 49 and moves the spool 38 to uncover the port 41 and allow fluid into the control line 32 to decrease the capacity of the pump 10. Thus the transmission ratio (i.e. the ratio of the capacity of the pump 10 to capacity of the motor 24) is decreased and the pressure in the conduit 22 will decrease. In the limit the capacity of the pump 10 will be reduced to zero so that there is no flow from the pump 10.

When the pressure in the conduit 22 drops the poppet 69 will prevent flow through the port 103 and the pressure will rise in the chamber 60 and, due to the differential area of the chambers 59 and 60 the piston 57 will be moved along the bore 58 away from the endcap 73 and allow the spool to return to a zero flow position. The control member 43 may then be manipulated to return the pump 10 to its original capacity.

If desired, a feed back link may be fitted between the swashplate 17 and the body 37 so that movement of the swashplate 17 due to displacement of the spool 38 moves the body 37 so as to cut off the flow through the ports 41, 42.

In this case the control member 43 will have a unique position for each value of pump capacity and the pump 10 will return to its predetermined position automatically after the action of the overload device.

What I claim is:

1. A variable capacity hydraulic machine having a fluid outlet conduit, adjusting means for varying the capacity of said machine including a fluid pressure source, a servo motor and a valve means to control said servo motor, said valve means connected to said fluid pressure source to receive pressurized fluid therefrom, manual control means operable upon said valve means to cause flow to or from said servo motor, and a control comprising override means operable upon said valve means to cause movement thereof to reduce the capacity of said machine upon fluid pressure in said conduit attaining a predetermined level, actuating means operable upon said override means and including a piston slidable within a cylinder and defining two chambers therein connected by a restrictive passage, one of said chambers being subjected to the pressure of fluid in said outlet conduit and the other of said chambers being connected to a pressure regulator, said pressure regulator operable upon attainment of said predetermined pressure in said other chamber to vent said other chamber and cause said piston to move relative to said cylinder to actuate said override means.

2. The machine of claim 1 wherein said restrictive passage is formed in said piston.

3. The machine of claim 1 wherein said chambers are of differing cross sectional area, said piston being biased in one direction when said pressure regulator is closed.

4. The machine of claim 1 wherein said pressure regulator is a poppet valve controlling flow from said other chamber to a sump.

5. The machine of claim 1 wherein said piston is connected to a piston rod, said piston rod being operable upon said override means.

6. The machine of claim 5 wherein said override means are operable upon said valve means to cause movement of said servo motor.

7. The machine of claim 5 wherein said piston rod extends through said one chamber, thereby creating a differential cross sectonal area.

* * * * *